United States Patent [19]

Tsukamoto

[11] Patent Number: 4,481,781

[45] Date of Patent: Nov. 13, 1984

[54] LIQUEFIED GAS TRANSFER APPARATUS

[75] Inventor: Masuya Tsukamoto, Hyogo, Japan

[73] Assignee: Kabushiki Kaisha Teikoku Denki Seisakusho, Tokyo, Japan

[21] Appl. No.: 380,534

[22] Filed: May 21, 1982

[30] Foreign Application Priority Data

May 29, 1981 [JP] Japan ..... 56-83556

[51] Int. Cl.[3] ..... F17C 7/02

[52] U.S. Cl. ..... 62/55; 318/773; 417/36; 417/424; 417/901

[58] Field of Search ..... 62/55; 318/773; 417/36, 417/424, 901

[56] References Cited

U.S. PATENT DOCUMENTS 2,764,873 10/1956 Mooyart ..... 62/55

3,794,870 2/1974 Broadway et al. ..... 318/773

*Primary Examiner*—Ronald C. Capossela

*Attorney, Agent, or Firm*—James E. Nilles

[57] ABSTRACT

A liquefied gas transfer apparatus having a recirculation passage for recirculating the liquefied gas sucked into a glandless pump back into the closed tank, and a device for changing the speed of the pump driving motor by suitable measures such as pole change, Y-Δ switching, frequency control, primary voltage control or the like. In operation, the pump is driven at a high speed during the transfer of the liquefied gas from the tank to the containers or the like, whereas, in the period in which the transfer of the gas in not necessary, the pump is continuously operated at a low speed while recirculating the liquefied gas through the recirculation passage, thereby to prevent the evaporation of the liquefied gas in the pump to ensure smooth and safe intermittent operation of the pump, as well as prolonged life of the bearing. The operation of the pump at the low speed considerably saves the electric power in the period requiring no transfer of the liquefied gas, so that the overall economy of the apparatus is improved remarkably.

5 Claims, 4 Drawing Figures

LIQUEFIED GAS TRANSFER APPARATUS

BACKGROUND OF THE INVENTION

1. Field of the Invention

The present invention relates to an apparatus for transferring liquefied gas.

2. Description of the Prior Art

Generally, glandless pumps such as pumps having a canned type motor or wet type motor are used in apparatus for transferring liquefied gas from a closed tank to a container or the like, because the glandless pumps are easy to assemble and completely free from the problem of leakage as compared with pumps having mechanical shaft seals. The glandless pumps are also advantageous as compared with pumps having oil immersion type motors, because insulation oil and a device for supplying insulation oil are not necessary and because the handling is easy. For these reasons, the glandless pumps are now finding increasing use.

The liquefied gas in the glandless pump is heated by the heat generated as a result of pump loss and motor loss. This, however, does not impose any problem because the liquefied gas does not stagnate in the pump but steadily flows through the pump during the operation of the pump, so that the amount of heat received per unit of volume of the liquefied gas is so small that the liquefied gas in the pump is never heated excessively.

However, in the case where the transfer of the liquefied gas is made discontinuously and frequently by intermittent and frequent start and stop of the pump as in the case of an LP gas station, the liquefied gas in the pump is evaporated to hinder the smooth transfer of the liquefied gas.

Namely, as the pump is stopped after completion of the transfer of liquefied gas, the liquefied gas stagnated in the pump is heated by the residual heat, so that the amount of heat received by a unit volume of the liquefied gas is drastically increased. In consequence, the liquefied gas is heated excessively and evaporated rapidly. The vapor then escapes, as time elapses, into the closed tank through the pump suction pipe and into the upper part of the pump discharge pipe, and then the pump itself is filled with the liquefied gas. However, if the pump is started without removing the vapor from the pump, a phenomenon called cavitation takes place to make the pump idle with a high level of noise and fail to transfer the liquefied gas. In consequence, the pump cannot fully exert its performance, and the bearing is worn down rapidly due to insufficient lubrication, resulting in trouble.

In the case of an immersion type glandless pump, e.g. a liquid immersion type canned motor pump which is contained in a closed tank 2 as shown in FIGS. 1 and 2, the following problems are encountered in addition to the problems mentioned above. Namely, if the liquid level in the closed tank 2 is lowered below the level of the bearing 10*a* or bearing 10*b* or the bearing 11, the bearing 10*a* or 10*b* or 11 cannot be immersed in the liquefied gas 5 during suspension of operation of the pump. Therefore, the bearing 10*a*, 10*b* or 11 has to work without being lubricated over a period of several seconds from the start up of the pump 4 till the recirculation of the liquefied gas 5 to the bearing 10*a*, 10*b* or 11, so that the wearing down of the bearing takes place abnormally rapidly. To ensure the safe operation of the pump, therefore, it is necessary to make a periodical disassembling for inspection at an early stage.

The disassembling of the liquid-immersed type canned motor pump 4 is very troublesome, time-consuming and expensive because the pump 4 cannot be demounted without completely removing the liquefied gas 5 in the closed tank 2 and because the opening examination of the tank 2 is necessary once it is opened to the atmosphere.

To avoid these problems, as shown in FIGS. 1 and 2 showing a canned motor pump 4 as an example of the immersion type glandless pump and in FIG. 4 showing a canned motor pump 4 as an example of the ground mounting type glandless pump, the pump 4 is operated continuously even when the transfer of the liquefied gas 5 to a container or the like is not necessary, although the valve 7 is kept closed. By so doing, the liquefied gas 5 is sucked into the pump 4 from the closed tank 2 and is returned to the closed tank 2 through the discharge pipe 1 and a by-pass passage 3, to maintain a continuous flow of the liquefied gas through the pump, thereby to prevent the evaporation of the liquefied gas 5 in the pump 4. This method, however, is not preferred because the running cost is very high due to the continuous running of the pump even in the period in which the transfer of liquefied gas is not necessary.

SUMMARY OF THE INVENTION

Accordingly, it is a primary object of the invention to provide a liquefied gas transfer apparatus which can obviate the above-described problems of the prior art.

To this end, according to the invention, there is provided a liquefied gas transfer apparatus having a recirculation passage for recirculating the liquefied gas sucked into a glandless pump back into the closed tank, and means for changing the speed of the pump driving motor by suitable measures such as pole change, Y-Δ switching, frequency control, primary voltage control or the like. In operation, the pump is driven at a high speed during the transfer of the liquefied gas from the tank to containers or the like, whereas, in the period in which the transfer of the gas is not necessary, the pump is continuously operated at a low speed while recirculating the liquefied gas through the recirculation passage, thereby to prevent the evaporation of the liquefied gas in the pump to ensure smooth and safe intermittent operation of the pump, as well as prolonged life of the bearing. In addition, the operation of the pump at the low speed considerably saves electric power in the period when no transfer of the liquefied gas is required so that the overall economy of the apparatus is improved remarkably.

Other objects, features and advantages of the invention will become clear from the following description of the preferred embodiments taken in conjunction with the accompanying drawings.

DESCRIPTION OF THE PREFERRED EMBODIMENTS

Figure 1:
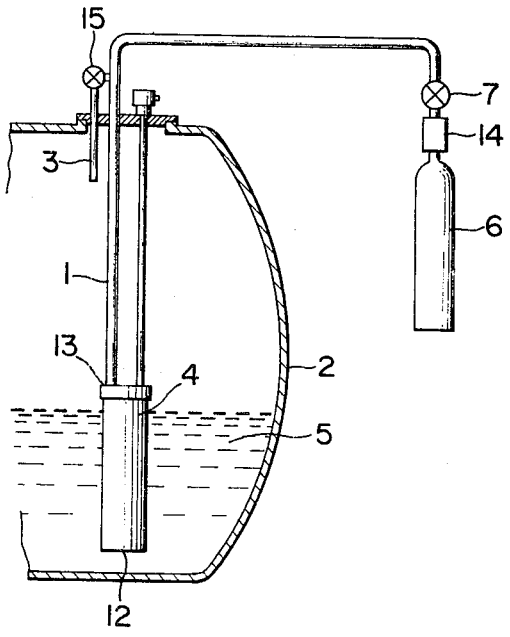
FIG. 1 is a sectional view of a part of a liquefied gas transfer apparatus in accordance with an embodiment of the invention.
Figure 2:
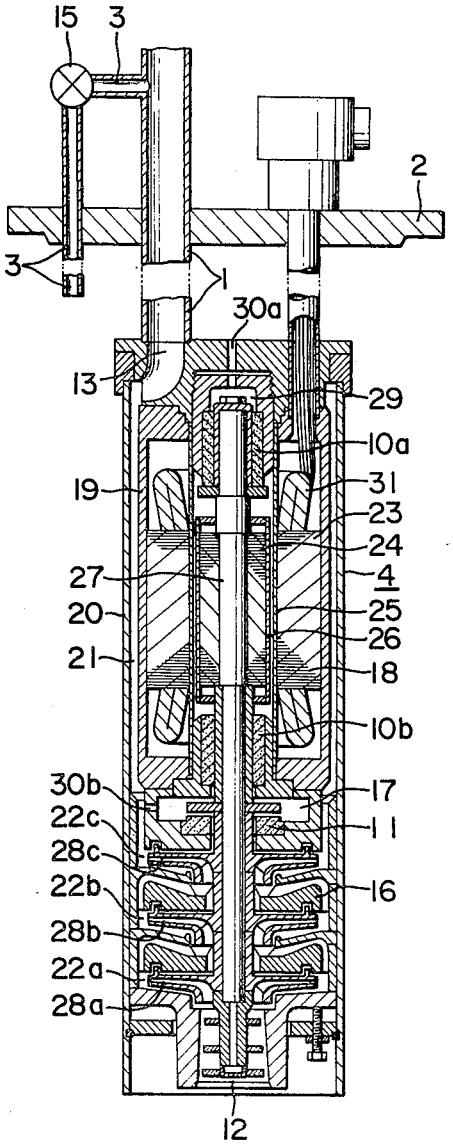
FIG. 2 is an enlarged sectional view of a glandless pump incorporated in the apparatus shown in FIG. 1.
Figure 3:
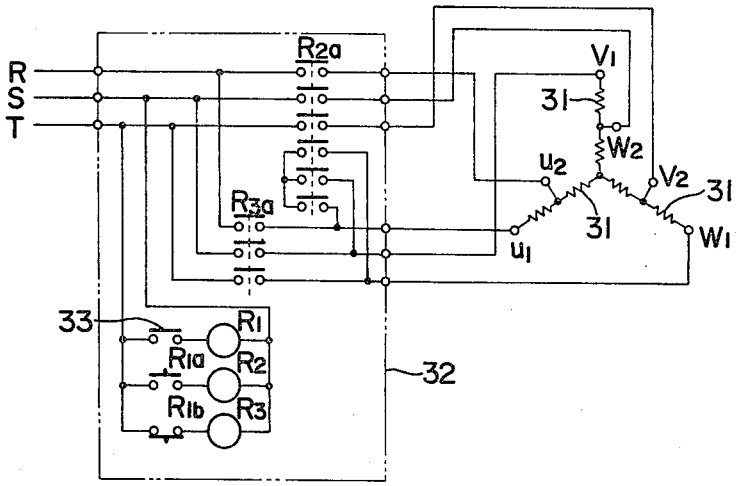
FIG. 3 is an electric circuit diagram of an electric circuit of the apparatus shown in FIG. 1.

A liquefied gas transfer apparatus in accordance with a first embodiment of the invention, employing a liquid immersion type canned motor, of which the speed is changeable by pole exchange will be described with specific reference to FIGS. 1 through 3.

A liquid immersion type canned motor pump 4 disposed in a lower part of a closed tank 2 storing a liquefied gas 5 has a downwardly directed suction port 12 and an upwardly directed discharge port 13. A discharge pipe 1 suspended in a gas-tight manner from the tank 2 is connected to the discharge port 13. A coupling 14 is connected to the other end of the discharge pipe 1 in a gas-tight manner through a valve 7. The connection of the discharge pipe 1 to a container 6 or the like is made through this coupling 14.

A by-pass passage 3 opening into the closed tank 2 is connected to the discharge pipe 1 through a regulating valve 15.

In the canned motor pump 4, a canned motor 18 is integrally connected to the upper side of the multi-stage pump 16 through a lower fluid chamber 17. The canned motor 18 has also a frame 19 which is disposed in the casing 20 of the canned motor pump 4 concentrically with the casing 20 so that a discharge passage 21 is formed between the casing 20 and the frame 19. The discharge passage 21 is connected at its upper end to the discharge pipe 1 and at its lower end to the discharge side of the pump chamber 22*c* of the final stage of the multiple stages of pump chambers 22*a*, 22*b* and 22*c*.

A stator 23 fixed to the frame 19 and a rotor 24 mounted inside of the stator 23 are completely closed by a stator can 25 and a rotor can 26 which are made of non-magnetic thin metallic material. The rotor 24 is fitted to a rotor shaft 27 which is rotatably supported by radial bearings 10*a*, 10*b* provided at the upper and lower sides of the rotor 24 and also by a thrust bearing 11 disposed in the lower fluid chamber 17. This rotor shaft 27 extends through the multiple stages of pump chambers 22*a*, 22*b* and 22*c* and is fitted to impellers 28*a*, 28*b* and 28*c* disposed in these pump chambers 22*a*, 22*b* and 22*c*.

An upper fluid chamber 29 is provided on the upper side of the radial bearing 10*a* of the canned motor 18 so as to surround the upper end of the rotary shaft 27. This upper fluid chamber 29 is opened to the outside of the canned motor pump 4, i.e. into the closed tank 2 through an aperture 30*a*. The lower fluid chamber 17 is communicated with the discharge passage 21 through an aperture 30*b*.

The stator 23 of the canned motor 18 is provided with a coil winding 31 which is reconnectable for either 2-pole or 4-pole operation. The coil winding 31 is connected to a three-phase power supply RST through a pole change circuit 32 consisting of relays R1, R2 and R3 as shown in FIG. 3. The relay R1 has contacts R1a, R1b, while the relays R2 and R3 have contacts R2a and R3a, respectively. The arrangement is such that the canned motor 18 operates with two poles when the valve 7 is opened, by the action of a switch 33 interlocked to the valve 7, whereas, when the valve 7 is kept closed, the canned motor 18 operates with full poles, i.e. four poles.

The liquefied gas transfer apparatus of this embodiment has a transfer line between the closed tank 2 and the container 6 or the like through the suction port 12, multiple stages of pump chambers 22*a*, 22*b*, 22*c*, discharge passage 21, discharge pipe 1 and the valve 7. The apparatus has also a first recirculation passage for recirculating the liquefied gas from and to the closed tank 2 through the suction port 12, pump chambers 22*a*, 22*b*, 22*c*, discharge passage 21, discharge pipe 1, and the by-pass passage 3. The apparatus further has a second recirculation passage for recirculating the liquefied gas from and to the closed tank 2, through the suction port 12, pump chambers 22*a*, 22*b*, 22*c*, lower fluid chamber 17, bearing 10*b*, gap between the can 25 and the can 26, bearing 10*a*, and the upper fluid chamber 29.

The operation of the liquefied gas transfer apparatus of this embodiment is as follows.

The canned motor 18 is continuously supplied with electric power from the source RST through the pole change circuit 32. As the valve 7 is opened after connecting the container 6 or the like to the coupling 14, the switch 33 interlocked to the valve 7 is turned on so that the relays R1, R2 and R3 of the pole change circuit 32 are operated to switch the operation mode to the two-pole operation to permit the canned motor pump to operate at a high speed. In consequence, the liquefied gas 5 is sucked from the closed tank 2 through the suction port 12 of the pump and is pressurized as it flows through multiple stages of pump chambers 22*a*, 22*b* and 22*c* and is discharged from the discharge side of the pump chamber 22*c* of the final stage. The liquefied gas is then discharged into the discharge pipe 1 through the discharge passage 21 while effectively cooling the stator 23 of the canned motor 18, and is transferred to the container 6 or the like through the valve 7 and the coupling 14. Thus, the liquefied gas is transferred through the transfer line, and a part of the liquefied gas 5 discharged to the discharge pipe 1 is recirculated through the by-pass passage 3 via the regulating valve 15, i.e., through the first recirculation passage.

At the same time, a part of the liquefied gas 5 flowing in the discharge passage 21 is introduced into the lower fluid chamber 17 through the aperture 30*b* so as to lubricate the thrust bearing 11 and the lower radial bearing 10*b*. This part of the liquefied gas is introduced into the canned motor 18 to flow in the gap between the stator can 25 and the rotor can 26 to effectively cool the stator 23 and the rotor 24 and it further flows into the upper fluid chamber 29 through the upper radial bearing 10*a*. This part of the liquefied gas is then discharged to the outside of the canned motor pump 4, i.e. into the closed tank 2 through the aperture 30*a*. Thus, this part of the liquefied gas is recirculated through the second recirculation passage.

After the completion of charging of the container 6 or the like, the valve 7 is closed so that the switch 33 interlocked to the valve 7 is cut-off from operating the relays R1, R2, R3 of the pole change circuit 32, so that the operation mode of the canned motor 18 is switched to four-pole operation at a low speed. In this case, the liquefied gas 5 from the closed tank 2 is not transferred to the container 6 or the like but is recirculated from and to the closed tank 2 through the first recirculation passage, i.e. the suction port 12, multiple stages of pump chambers 22*a*, 22*b*, 22*c*, discharge passage 21, discharge pipe 1 and the by-pass passage 3. On the other hand, a part of the liquefied gas flowing in the discharge passage 21 is introduced into the canned motor 18 through the lower fluid chamber 17 as in the case of the high-speed operation of the motor. The liquefied gas is then returned to the exterior of the canned motor pump 4 through the upper fluid chamber 29, i.e. through the second recirculation passage.

During the four-pole operation of the canned motor pump 4, the speed of the motor is about a half of that in high-speed operation in the two-pole operation mode with the valve 7 closed, so that the discharge head of the pump is reduced to about $\frac{1}{4}$. This small discharge head is sufficient because, in this case, it is not necessary to pump the liquefied gas into the container 6 or the like at high pressure but it is required only to recirculate the liquefied gas through the first and second recirculation passages. Although the discharge rate is reduced almost to a half, the pump driving power is also decreased to about $\frac{1}{8}$. In consequence, the rate of generation of heat from the canned motor pump 4 is remarkably decreased. Therefore, the undesirable evaporation of the liquefied gas 5 recirculated through the recirculation passages does not take place even though the discharge rate is reduced almost to a half. Namely, the amount of heat received per unit volume of the liquefied gas 5 flowing in the canned motor pump 4 is remarkably decreased to eliminate evaporation in the canned motor pump 4. In consequence, the bearings 10*a*, 10*b* and 11 are continuously lubricated so that the undesirable transfer failure and extraordinary wear of bearings 10*a*, 10*b* and 11 are avoided advantageously.

In addition, as stated before, the electric power consumed by the pump is decreased to about $\frac{1}{8}$ as compared with the case in which the canned motor pump 4 is operated at high speed in two-pole operation mode with the valve 7 kept closed. Therefore, the electric power which is wastefully consumed by the canned motor pump 4 in the period requiring no transfer of liquefied gas is largely decreased.

In the conventional apparatus, as stated before, when the liquid level in the closed tank 2 is lowered to a level below the bearing 10*a*, 10*b* or 11, it is often experienced that the pump operates without lubrication of the bearings 10*a*, 10*b* and 11 for several seconds after the start of supply of the liquefied gas to shorten the life of the bearing. This problem is completely avoided in the apparatus of the invention because the bearings are continuously lubricated even during suspension of operation of the canned motor pump 4.

In the described embodiment, the pole change of the canned motor 18 is made automatically through the action of the switch 33 interlocked to the valve 7. This arrangement, however, is not exclusive and the pole change of the canned motor 18 may be made independently of the operation of the valve 7.

The 2/4 pole change is not exclusive and the numbers of the poles can be selected suitably in accordance with the specification. The ratio of the speed change is preferably made large to further decrease the wasteful power consumption provided that a discharge head sufficient for maintaining the recirculation of the liquefied gas 5 in low-speed operation is ensured and that the discharge rate sufficiently large to avoid the evaporation of the liquefied gas 5 is obtained.

In the described embodiment, there are provided two recirculation passages: namely a first recirculation passage including the by-pass passage 3 and the second recirculation passage including the bearings 11, 10*a* and 10*b* and the interior of the canned motor 18. The first recirculation passage including the by-pass passage 3, however, may be dispensed with if such a construction is adapted as to ensure a recirculation rate large enough to avoid the evaporation of the liquefied gas 5 by decreasing the flow resistance in the second recirculation passage, for example, increasing the sizes of the apertures 30*a*, 30*b*, increasing the gap between the stator can 25 and the rotor can 26, providing a vertical groove or the like in the bearings 10*a*, 10*b* or forming apertures in the holders of the bearings 10*a*, 10*b*.

The revolution speed of the canned motor 18 may be changed by other means than pole change. For instance, it is possible to provide the stator 23 with Y-Δ coil winding 31 to permit the speed change by Y-Δ switched. It is also possible to adopt primary voltage control for the change of speed of the canned motor 18. In this case, a part of the waveform of the electric power is cut-off by a thyristor or the like to change the effective voltage applied to the coil winding 31 thereby to change the torque of the canned motor 18 so that the speed is determined naturally in accordance with the torque-speed characteristics of the impellers 28*a*, 28*b* and 28*c*. It is still possible to change the speed of the canned motor 18 by varying the frequency of the electric current applied to the coil winding 31 through a suitable frequency control device.

Figure 4:
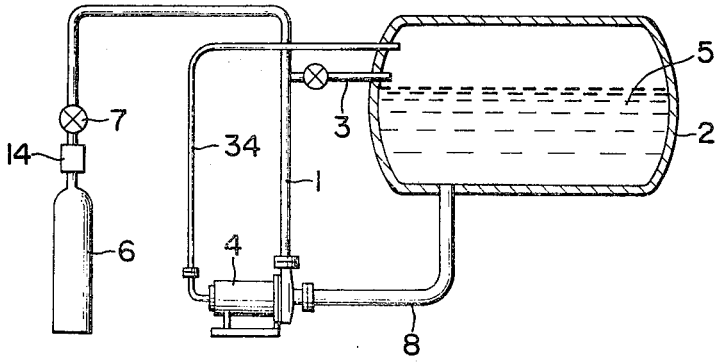
FIG. 4 shows a piping arrangement of a liquefied gas transfer apparatus in accordance with another embodiment of the invention.

Although the invention has been described in a specific embodiment applied to a liquefied gas transfer apparatus employing a liquid-immersion type canned motor pump, needless to say, the invention is applicable to a liquefied gas transfer apparatus incorporating a ground mounting type canned motor pump as shown in FIG. 4. In this case, for the recirculation of the liquefied gas 5, there are provided two recirculation passages: namely, a first recirculation passage including the discharge pipe 1 and the by-pass passage 3 leading to the closed tank 2, and a second recirculation passage including the space in the canned motor of the canned motor pump 4, bearings and the recirculation pipe 34 leading to the closed tank 2. The liquefied gas recirculated through the second recirculation passage effectively cools the canned motor and lubricates the bearings. As in the case of the liquid-immersion type canned motor pump stated before, the first recirculation passage may be neglected provided that the rate of recirculation through the second recirculation passage is increased sufficiently. It is also to be noted that a substantially similar effect is obtained when the invention is applied to a wet type motor pump which is a kind of glandless pump.

As has been described, according to the invention, there is provided a liquefied gas transfer apparatus having a recirculation passage for recirculating the liquefied gas sucked into a glandless pump back to the closed tank, and means for changing the speed of the pump driving motor such that, when the liquefied gas is transferred from the closed tank, the pump is operated at a high speed but the speed of the pump is lowered when the liquefied gas is not transferred. Accordingly, it is possible to maintain the recirculation of the liquefied gas so that the amount of heat received per unit volume of liquefied gas is decreased to avoid the evaporation of the liquefied gas in the pump. Therefore, the problems inevitable in the conventional liquefied gas transfer apparatus, such as transfer failure or insufficient lubrication of bearings are perfectly overcome to ensure a smooth operation of the pump. In addition, the life of the bearing is remarkably increased. Furthermore, the wasteful consumption of electric power is decreased remarkably as compared with the conventional apparatus in which the pump is operated at a high speed even when the liquefied gas is not being transferred. Namely, the electric power required for operating the pump during suspension of the transfer is significantly decreased to save electric power. The apparatus of the invention is free also from the problem encountered by the conventional liquefied gas transfer apparatus employing a liquid-immersed type glandless pump, i.e. the problem that the pump has to work without lubrication of bearings thereof for several seconds after the start up when the liquid level in the closed tank is lowered below the level of the bearings. Thus, the liquefied gas transfer apparatus of the invention has a superior overall economy as compared with the conventional apparatus which required a frequent disassembling and inspection of the glandless pump due to extraordinarily rapid wear of the bearings.

What is claimed is:

1. Apparatus for transferring liquefied gas from a closed tank to a container, comprising a discharge pipe having an outlet end to which a container is connectable and having an inlet end, a glandless pump connected with the inlet end of said discharge pipe and whereby liquefied gas is drawn from said tank and is delivered to said discharge pipe, an electric motor by which the pump is driven and to which the pump also delivers withdrawn liquefied gas to be circulated through the motor and back to the tank for motor cooling and lubrication, and a valve connected in the discharge pipe between its said ends and movable between an open position permitting flow of liquefied gas to said outlet end and a closed position preventing such flow, said apparatus being characterized by:

switching means (1) having an operative connection with said valve to be responsive to the position thereof, and (2) connected with said electric motor and arranged (a) to energize said motor for operation at a high speed when said valve is in its open position, so that said pump can then deliver liquefied gas from said tank to a container connected with the discharge pipe as well as to the motor, and (b) to energize said motor for operation at a substantially lower speed when said valve is in its closed position, to thereby prevent vaporization of liquefied gas in the pump and the motor with a low expenditure of electric power while maintaining delivery of liquefied gas to the motor for its cooling and lubrication.

2. The apparatus of claim 1, further characterized by: said switching means being arranged to provide said motor with a lesser number of effective poles when said valve is in its open position than when said valve is in its closed position.

3. The apparatus of claim 1, further characterized by: said switching means being arranged for a Y connection of the motor windings in one of said positions of the valve and a Δ connection of the motor windings in the other of said positions of the valve.

4. The apparatus of claim 1 wherein said switching means is arranged to change the operating speed of the motor by changing the effective voltage applied to its coil windings.

5. The apparatus of claim 1 wherein said switching means is arranged to change the operating speed of the motor by changing the frequency of electric current applied to its coil windings.

* * * * *